United States Patent [19]

Signorelli et al.

[11] 4,214,530

[45] Jul. 29, 1980

[54] METAL PRINTING PLATE

[76] Inventors: John A. Signorelli, 12348 Bennington, St. Louis, Mo. 63141; Gary C. Glanzner, 5083 Town Center Dr., St. Louis, Mo. 63128

[21] Appl. No.: 880,459

[22] Filed: Feb. 23, 1978

[51] Int. Cl.[2] ..... B41F 27/12

[52] U.S. Cl. ..... 101/415.1

[58] Field of Search ..... 101/415.1; 51/364, 365, 51/370

[56] References Cited

U.S. PATENT DOCUMENTS

| | | | |
|---|---|---|---|
| 2,172,144 | 9/1939 | Oakes | 101/375 |
| 2,209,127 | 7/1940 | Lowe | 101/415.1 |
| 2,898,854 | 8/1959 | Crawford | 101/415.1 |
| 2,963,969 | 12/1960 | Sanberlich | 101/415.1 |
| 2,990,000 | 6/1961 | Mangus et al. | 101/415.1 |
| 3,387,559 | 6/1968 | Horner | 101/415.1 |
| 3,408,933 | 11/1968 | Hermach et al. | 101/415.1 |
| 3,425,348 | 2/1969 | Hermach et al. | 101/415.1 |
| 3,608,487 | 9/1971 | Leuhrs | 101/415.1 |
| 3,626,848 | 12/1971 | Tafel et al. | 101/415.1 |
| 3,757,691 | 9/1973 | Etchell et al. | 101/415.1 |
| 3,897,191 | 7/1975 | Sannders et al. | 101/415.1 |

*Primary Examiner*—William Pieprz

*Attorney, Agent, or Firm*—Lionel L. Lucchesi

[57] ABSTRACT

A preformed, thin metal printing plate is provided which permits the plate to snap on and lock to the printing cylinder of an offset printing device so that the plate is juxtapositioned the cylinder along the entire plate area between a leading edge of the plate and a reverse bend part of a trailing edge of the plate.

11 Claims, 7 Drawing Figures

METAL PRINTING PLATE

BACKGROUND OF THE INVENTION

This invention relates to printing plates, and in particular, a printing plate adapted for self-locking to the plate cylinder of a press apparatus.

Offset printing presses, for example, employ printing cylinders having thin, metal plates attached to them. The cylinders conventionally have an axial groove in their outer surface that extends radially within the cylinder. Commonly, the printing plates are prepared for positioning on the cylinder by preforming bends on the plates, for example, along a leading edge and a trailing edge of the plate, to facilitate their attachment. After bending, the plates are wrapped around the cylinder periphery by attaching the leading edge of the plate to one edge defining the axial groove in the cylinder, and thereafter wrapping the plate around the cylinder until the trailing edge of the plate enters the groove at the opposite, second edge defining the axial groove in the cylinder. Conventionally, two plates are required to cover the periphery of the cylinder.

A number of arrangements have been proposed for holding the plates in position on the cylinders. In general, these arrangements have employed the use of an oversized printing plate, that is to say, oversized with respect to the peripheral dimension of the printing cylinder and some cam operated latching mechanism which engages at least one of the leading and trailing edges of the plate to tension the plate in the running position of the cylinder. Examples of this form of construction are shown in the U.S. Pat. 3,626,848 to Tafel and Etchell, U.S. Pat. No. 3,757,691.

Where the plates have not been oversized, they still have required complicated cam arrangements to secure the plates to the cylinder, as for example, shown in the U.S. Pat. No. 3,608,487 to Leuhrs.

While these various examples of plate and plate tensioning assemblies work for their intended purpose, they all have shortcomings, economic or otherwise, which become apparent either during manufacture or operation of the associated printing press. For example, the tensioning type of construction as described in the Tafel U.S. Pat. No. 3,626,848, in which the fingers engage at least an end of the printing plate, causes that end of the printing plate engaged by the tensioning device to be drawn away from the supporting structure of the cylinder. This occurs in the area of the groove or slot extending into the radial depth of the cylinder so that the printing plate is unsupported along that groove. The plate cylinder, in operational use, contacts ink rollers, a water form roller and a blanket cylinder, which under some pressure, applies ink and water to the plate and permits the transfer of the desired information from the plate cylinder to the blanket cylinder. As this operation occurs, the various rollers tend to force the unsupported portion of the printing plate inwardly of the groove in the plate cylinder, flexing the printing plate each time the ink and water rollers crosses a groove in the plate cylinder. This flexing eventually weakens the material from which the plate is constructed, with the result that the plates crack and tensioning grip is lost on the plates. Eventually, the plate separates from the plate cylinder. Plate separation causes press down time, and results in the loss of web material. Often, plate separation also damages the relatively expensive printing blanket carried by the blanket cylinder.

To guard against the possibility of plate breakage, it has been common to use relatively thick printing plates, in the order of twelve thousandths thicknesses and above, for the plates. While thicker plates tend to reduce the occurence of plate breakage, it has not heretofore prevented such plate breakage and the loss attended with that breakage.

We have found that the cause of plate breakage is a result of the fact that many plates are oversized with respect to the printing cylinder, and that oversize has resulted in the above described plate deterioration.

We further have found that the breakage problems inherent with prior art plate designs may be eliminated, and that a thinner plate material may be employed in the plates when the plate is sized to fit the plate cylinder snugly and is formed with a special reverse bend on one of the edges of the plate. The spacing of two positioning bends in the plate is chosen so that the plate must be forced over the edges of the axial groove in the cylinder. That is, the plate actually must be snapped into position. A reverse bend outboard of one of the positioning bends facilitates application of the plate to plate cylinders and helps maintain the tension of the plate on the plate cylinder so that the plate remains in position, even if some elongation of the plate occurs during use. Surprisingly, plate elongation has not been found to be a problem when the reverse bend is used in conjunction with the positioning bends arranged so that the plate must snap on the plate cylinder. The plate also is compatible with a wide range of press types, and while the locking mechanisms of the prior art are not required to hold the plate in position on the press, the plate of this invention may be employed with pressed employing such locking mechanisms. When so employed, however, the locking mechanisms are engaged in the reverse sense of their intended function. Such prior art locking mechanisms commonly have cam operated fingers arranged to engage one end of the plate. The fingers, under cam control, have a first plate insertion position and a second plate locking position. When the plate of our invention is employed, the prior plate locking position of the fingers becomes the plate insertion position, while the prior plate insertion position becomes the plate locking position.

In use, the plate of this invention has resulted in considerable material cost savings in that a plate thickness of less than twelve thousandths of an inch, and having a length dimension shorter than prior art plates may be employed. Plate thicknesses in the range of eight to nine thousandths consistently have been employed without adverse affect. Plate breakage in normal use with presses employing our plate have been nonexistent. In one application, the plates are employed for printing newspapers for a large metropolitan newspaper. In that application, use of the plate of this invention has resulted in an estimated one hundred thousand dollar a year savings in material cost alone. Although press down time savings have not been calculated, plate breakage has been deminimis. Consequently, additional savings from reduced waste and lower labor costs are expected.

One of the objects of this invention is to provide a low cost plate structure for printing cylinders.

Another object of this invention is to provide a snap-on, self-locking plate for plate cylinders.

Another object of this invention is to provide a plate for printing cylinders that is compatible with existing cylinder designs.

Yet another object of this invention is to provide a plate cylinder construction which may employ plates having thicknesses less than twelve thousandths of an inch.

Still another object of this invention is to provide a plate cylinder, the surface area of which has two positioning bends formed in it so as to define a leading edge, and a trailing edge, the trailing edge having a reverse bend formed in it out-board of the positioning bend.

Other objects will be apparent to those skilled in the art in light of the following description and accompanying drawings.

SUMMARY OF THE INVENTION

In accordance with this invention, generally stated, a preformed metallic printing plate has a predetermined length and width, the width dimension delimiting a leading edge and a trailing edge. The leading edge is bent away from the plane of the main plate area in a first direction. The trailing edge also is bent away from the plane of the main plate area in the same direction as the first bend. A portion of the trailing edge outboard of the second bend further is bent in a direction opposed to the first and second bends. The first and second bends are located along the length dimension of the plate so that the entire plate, with the exception of that portion of the trailing edge outboard of the third bend, abuts a part of the plate cylinder when positioned on the plate cylinder. The reverse bend and positioning bend location spring lock the plate to the plate cylinder without the need of other interlocking mechanisms, and permit the reliable use of substantially thinner plates than possible with the prior art designs.

DESCRIPTION OF THE PREFERRED EMBODIMENT

Figure 1:
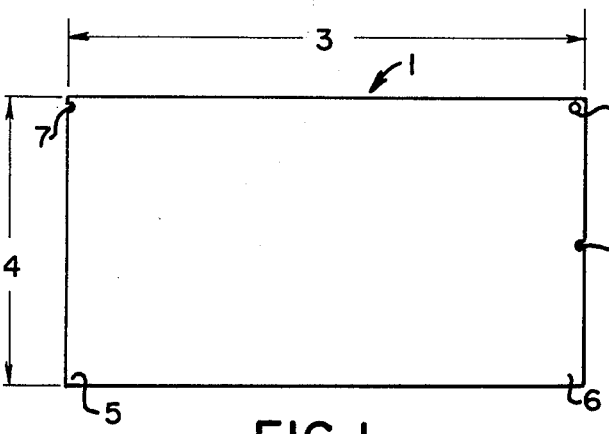
FIG. 1 is a top plan view of a metal printing plate prior to a bending in accordance with principles of this invention.

Referring now to FIG. 1, reference numeral 1 indicates a metal plate compatible with a plate cylinder 2 of an appropriate printing device. The plate 1 has a length dimension 3, a width dimension 4, a first end 5 and a second end 6.

Each of the ends 5 and 6 of the plate 1 has suitable locating notches 7 formed in them, which may be used to locate the plate both during plate manufacture and for plate bending operations later described. The edge 5 also has a locating opening 8 formed in it for a similar purpose. Other locating arrangements may be employed, if desired. Conventionally, and for purposes of this specification, plate manufacture refers to the construction of the sized metal blanks, an illustrative example of which is shown in FIG. 1, by a suitable punch press operation, for example.

Figure 7:
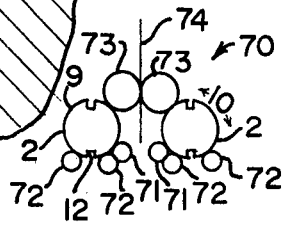
FIG. 7 is a diagrammatic view of a printing device employing our invention.

The cylinder 2 is conventional and generally has a outer periphery 9 having a peripheral dimension 10 and a radial depth 11. The periphery 9 of the cylinder 2 has at least one axially extending slot 12 formed in it, which conventionally extends for substantially the axial length of the plate bearing periphery 9. The slot 12 has an open mouth 13 and a pair of undercut surfaces 14 and 15, respectively, the surfaces 14 and 15 being directed radially inwardly of the mouth 13 toward a closed bottom 16 of the slot 12. The surfaces 14 and 15 meet the outer periphery 9 of the cylinder 2 at a pair of edges 17 and 18, respectively. As will be appreciated by those skilled in the art, design of the slot 12 may vary in other embodiments of this invention, and plate formation may depend upon the particular slot configuration employed. The cylinder 2 is employed in a printing device 70, best seen in FIG. 7. The device 70 has a pair of the cylinders 2 arranged to receiver a water and ink application from rollers 71 and 72, respectively, and to transfer the desired printing data to blanket roller 73. The blanket rollers 73 apply the data to a web 74 which is drawn past the blanket rollers 73 in a conventional manner. The cylinders 2, in the embodiment of FIG. 7, have a pair of grooves formed in them, on diametrically opposite sides of cylinder 2, the views in FIGS. 3–6 representing an enlargement of one of the grooves 12 in the cylinder 2.

Figure 2:
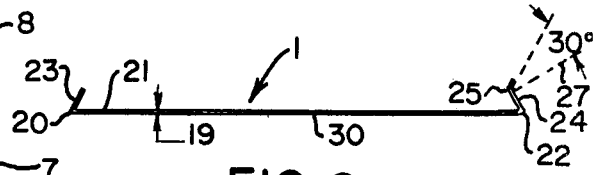
FIG. 2 is a view in side elevation of the plate shown in FIG. 1 after a three bend operation of this invention is performed on the plate.

Unbent plates 1 have a thickness 19 and are bent into a predetermined shape on any suitable bending apparatus. A device particularly well suited to form the bends of this invention is disclosed in a co-pending application by Wright, Ser. No. 925,192, filed July 17, 1978. Other bending devices are compatible with the broader aspects of this invention. In any event, the plate 1 has a first positioning bend 20 made in it in an upward direction from a main surface area 21 of the plate 1, upward being referenced to FIG. 2. The bend 20, in the embodiment illustrated, is equal to or greater than ninety degrees. That area of the edge 5 outboard of the bend 20 delimits a lead part 23 for the edge 5. The lead part 23 is designed to enter the slot 12, as later described.

The edge 6 has a second bend 22 formed in it, the bend 22 also being formed upwardly from the main surface area 21 of the plate 1. That portion of the edge 6 outboard of the bend 22 delimits a trailing part 24. The bend 22 also is equal to or greater than ninety degrees. Preferably, the bends 20 and 22 are between 117 degrees and 123 degrees. For the purposes of this specification, the bends 20 and 22 are defined as being in the same direction although the rotation of the bend 20 is opposite to the rotation of the bend 22. The bend in this particular instance is defined with reference to the plane of the main surface area 21 of the plate 1. With that reference, the bends 20 and 22 are made in the "same" direction.

The trailing part 24 further has a bend 25 formed in it so as to define a lead in 26. The bend 25 is opposite the bends at 22 and 20 in that had the bend 25 been formed first, it would be bent in a direction opposite from the plane of the main surface area 21 of the plate 1 from the direction in which both of the bends 20 and 22 are made. The degree of bend 25 is important and we have found that both too large and too small of an angle for the bend 25 limits the effectiveness of that bend. In general, the bend 25 is made so it defines an angle of approximately thirty degrees between the lead in 26 and an axis 27, the axis 27 generally being perpendicular to the trailing part 24.

Figure 3:
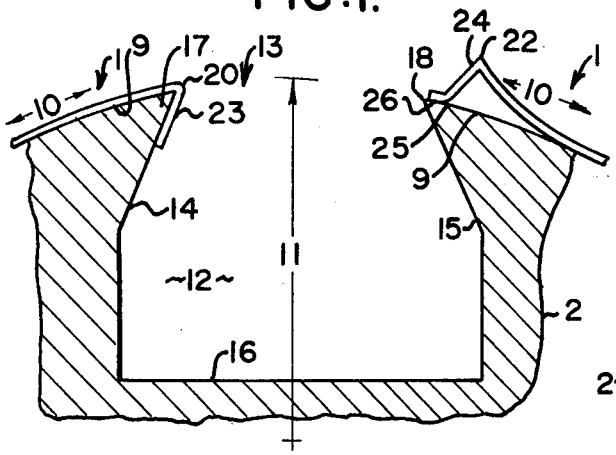
FIG. 3 is a sectional view, partly broken away, illustrating the placement of a pair of plates similar to that shown in FIG. 2, prior to the snap lock position of one of the plates of the pair.
Figure 4:
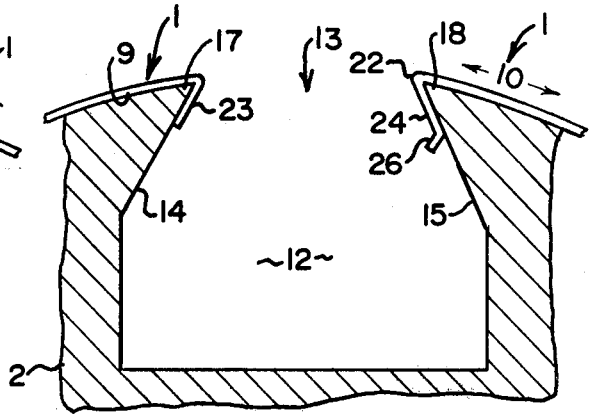
FIG. 4 is a sectional view, partly broken away, corresponding to FIG. 3, showing plates of this invention in their running position.
Figure 6:
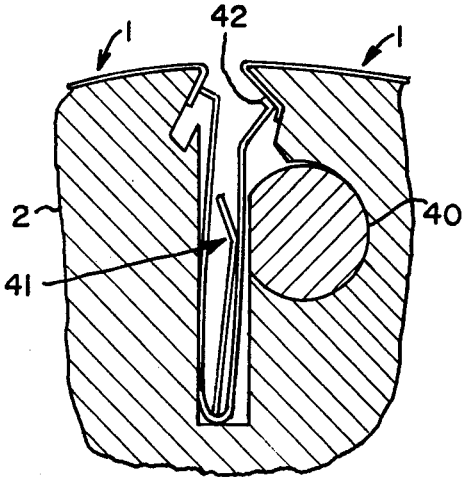
FIG. 6 is a sectional view of a first end of a plate cylinder, partly broken away, illustrating the employment of the plate of FIG. 2 with a prior locking mechanism, the locking mechanism being shown in an operating position previously used for inserting plates.
Figure 5:
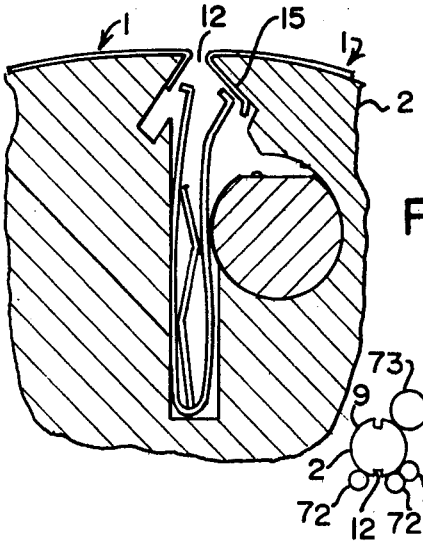
FIG. 5 is a sectional view of a first end of a plate cylinder, partly broken away, illustrating the employment of the plate of FIG. 2 with a prior art locking mechanism, the locking mechanism being shown in an operating position previously used for engaging plates.

In use, the plate 1 is formed on a suitable plate bender, after it has had the material requiring reproduction disposed on a side 30 of the suface area 21 by conventional processes. Thereafter, the plate 1 is taken to the cylinder 2 where the lead part 23 is placed against the surface 14 of the slot 12, the edge 17 fitting snugly within the bend 20. The plate 1 is then wrapped around the periphery 9 of the cylinder 2 until the lead in 26 is adjacent the edge 18. That location is illustrated in FIG. 3. As indicated above, the cylinder 2 conventionally has a pair of grooves 12 formed in it. FIG. 3 represents the lead part 23 of a first plate and the lead in 26 of a second plate. In any event, the lead in 26 permits the plate 1 to be placed over the edge 18. That is to say, the positions of the bends 20 and 22 along the length 3 of the plate 1 are chosen so that the length of the surface area 21 between the bends 20 and 22 are substantially equal to the greater value of the peripheral dimension 10 between the edges 17 and 18. Without the lead in 26, the material of the plate at the bend 25 would tend to dig into the material of the cylinder, inhibiting plate 1 placement. Instead, the lead in 26 enables the plate 1 to be drawn taut across the outer periphery 9 of the cylinder 2, so that the plate 1 can be snapped into a running position within the slot 12. In position, the trailing part 24 abuts the surface 15 while the edge 18 fits snugly within the bend 22. In the running position, the lead in 26 tends to hold the plate 1 against the surface 15 and periphery 9, even if some elongation of the plate 1 occurs.

As indicated above, the plate 1 is compatible with prior art locking mechanisms, although those mechanisms have their operating positions reversed. As diagrammatically illustrated in FIGS. 5 and 6, the prior art generally employs a cam 40 and spring means 41 to engage the metal plates. The cam means 40 was rotated to a position shown in FIG. 5 so that a set of fingers 42 was drawn outwardly from the surface 15 of the slot 12 to tension the plate in the running position. The cam means 40 was rotated to a position shown in FIG. 6 to permit removal of the plate. When the plate of our invention is used with cylinders 2 employing such tensioning devices, the fingers 42 are operated in their opposite sense for the inserting and run positions of the plate 1. That is, the tensioning position of the cam means 40 is used to permit insertion of the plate 1 within the slot 12, so that the lead part 23 and trail part 24 is positioned between the surfaces 14 and 15 and the fingers 42 of the spring means 41. Thereafter, the cam means 40 is rotated to what was the plate removal position of the prior art tension mechanism so that the fingers 42 abut the lead part 23 and trail part 24. Consequently, the plate of this invention is compatible with a wide range of printing cylinder structures.

Numerous variations, within the scope of the appended claims, will be apparent to those skilled in the art in light of the foregoing description and accompanying drawings. Thus, the length, width and thickness dimensions of the plate 1 may vary in other embodiments of this invention. Likewise, while preferred angles for the bends 20, 22 and 25 were described, other angles are compatible with the appended claims. The designations "leading" and "trailing" are for description only, as the direction of rotation of the plate cylinder 2 determines the relationship of leading and trailing with respect to the plate 2 edges. These variations are merely illustrative.

Having thus described the invention, what is claimed and desired to be secured by Letters Patent is:

1. In a plate lock up for a thin metal printing plate including a plate cylinder having at least one axially extending radial slot formed in the surface thereof, said slot being defined by a first surface, and a second surface oppositely opposed to said first surface, said cylinder having a cylinder peripheral dimension between a first edge and a second edge of said slot, the improvement comprising a preformed printing plate of metallic material having a leading edge and a trailing edge, the leading edge having an inwardly directed bend at least as great as ninety degrees so as to seat said first bend against said first surface, said trailing edge having a second inwardly directed bend at an axial distance from said first bend corresponding to the peripheral dimensions of said cylinder, said second bend being at least as great as ninety degrees so as seat said second bend against said second surface, and a third bend outboard of said second bend and formed in a direction opposite to said second bend, the portion of said plate outboard of said third bend defining a lead in for said plate permitting said plate to be snap locked into position on said cylinder, said lead in of said plate being spaced from said second surface while the entire remaining portion of said plate abuts some portion of said cylinder in the running condition of said cylinder, the distance between said first bend and said second bend being no greater than the peripheral dimension of said cylinder between the first and second edges of said slot, said first, second and third bends of said plate and the distance between said first and said second bends defining first means for locking said plate to said cylinder, said plate being snap locked in position on said cylinder and positionally locked thereto by the snap lock provided by said printing plate construction, said first locking means being effective to prevent axial movement of said plate with respect to said cylinder in the normal operation of said cylinder.

2. The improvement of claim 1 wherein said first and second bends are between one hundred seventeen and one hundred twenty-three degrees as measured in a counterclockwise direction from the plane of said plate, said third bend is approximately thirty degrees as measured between said third bend and an axis perpendicular to the trailing edge.

3. The improvement of claim 2 wherein said preformed plate has a thickness of less than twelve thousandths of an inch.

4. The improvement of claim 1 wherein said third bend is formed at an angle such that said lead in will abut said cylinder adjacent the entrance of the edge of said slot along the trailing edge of said plate prior to entrance of said trailing edge in said slot.

5. The improvement of claim 3 wherein said cylinder further includes second means for locking said plate to said cylinder, said second locking means comprising a locking mechanism in said slot, the leading and trailing edges of said preformed plate being interposed between said locking mechanism and respective ones of said first and second surfaces in the running position of said cylinder.

6. The improvement of claim 1 wherein said plate cylinder has two axially extending slots formed in it, pairs of said plates extending substantially about the peripheral dimensions of said cylinder.

7. A method of forming a first locking means for a metal plate and attaching the printing plate to a plate cylinder, said plate cylinder having an axial slot formed in it, said slot having a first edge and a second edge, and a predetermined peripheral dimension about said cylinder between said edges, comprising:

forming a rectangular shaped plate having a first end and a second end;

bending the first end at some predetermined position in a first direction for at least an angle of ninety degrees;

bending the second end of said plate at a predetermined distance from said first bend, said predetermined distance being no greater than the peripheral dimension of said cylinder, said bend being in a direction corresponding to said first bend;

bending the second end of said plate outboard of said second bend in a direction opposite to said first and said second bends for an amount less than ninety degrees, the area of said plate outboard of said last mentioned bend forming a lead in for said plate; and snap inserting said plate on said cylinder so that the entire plate is in contact with said cylinder except for that portion of the second end of the plate outboard of said third bend, said first, second and third bends of said plate and the predetermined distance between said first and said second bends defining first means for locking said plate to said cylinder, said plate being positionally locked to said cylinder along said slot merely by the structure of said printing plate, said first locking means preventing axial movement of the plate with respect to said cylinder in the normal operation of said cylinder.

8. The method of claim 7 wherein said plate has a thickness of less than twelve thousandths inch.

9. The method of claim 8 including the further step of positioning a second locking means against said first and said second ends so that said plate is interposed between said cylinder and said locking means.

10. In a plate lock up for a thin metal printing plate including a plate cylinder having at least one axially extending radial slot formed in the surface thereof,said slot being defined by a first surface, and a second surface directed oppositely to said first surface, said cylinder having a cylinder peripheral dimension between a first edge and a second edge of said slot, the improvement comprising a plate construction defining a first means for locking said plate to said cylinder including a preformed printing plate of metallic material having a leading edge and a trailing edge, the leading edge having an inwardly directed bend at least as great as ninety degrees so as to seat said first bend against said first surface, said trailing edge having a second inwardly directed bend at a distance from said first bend corresponding to the peripheral dimension of said cylinder, said second bend being at least as great as ninety degrees so as seat said second bend against said second surface, and a third bend outboard of said second bend and formed in a direction opposite to said second bend, the portion of said plate outboard of said third bend defining a lead in for said plate so as to permit said plate to be snap locked on said cylinder, said lead in of said plate being spaced from said second surface while the entire remaining portion of said plate abuts some portion of said cylinder in the running condition of said cylinder, the distance between said first bend and said second bend being no greater than the peripheral dimension of said cylinder, said first, second and third bends and the distance between said first bend and said second bend comprising first means for locking said plate to said cylinder, said plate being positionally locked to said cylinder merely by the snap lock provided by the plate construction, said first locking means preventing axial movement of said plate with respect to said cylinder during normal operation of said cylinder.

11. The improvement of claim 10 wherein said plate cylinder has two axially extending slots formed in it, pairs of said plates extending substantially about the peripheral dimensions of said cylinder.

* * * * *